US005535781A

United States Patent [19]

Paterson et al.

[11] Patent Number: 5,535,781

[45] Date of Patent: Jul. 16, 1996

[54] PUSH BUTTON FLUSH ACTIVATION SYSTEM FOR URINAL

[75] Inventors: Graham H. Paterson; Willard A. Denham, both of Wilmington, Del.

[73] Assignee: Speakman Company, Wilmington, Del.

[21] Appl. No.: 368,427

[22] Filed: Jan. 4, 1995

[51] Int. Cl.[6] ..... E03D 3/08; F16K 31/02

[52] U.S. Cl. ..... 137/624.11; 251/30.01; 251/121; 4/305

[58] Field of Search ..... 137/624.11, 624.12; 251/121, 129.01, 30.01; 4/301, 302, 303, 304, 305, 309, 410, 406

[56] References Cited

U.S. PATENT DOCUMENTS

| | | | |
|---|---|---|---|
| 2,738,448 | 3/1956 | Bokser . | |
| 3,792,497 | 2/1974 | Robbins | 4/410 X |
| 3,965,492 | 6/1976 | Hendricks . | |
| 4,309,781 | 1/1982 | Lissau . | |
| 4,471,498 | 9/1984 | Robertshaw . | |
| 4,586,692 | 5/1986 | Stephens | 4/410 X |
| 4,611,356 | 9/1986 | Lin . | |
| 4,742,583 | 5/1988 | Yoshida et al. . | |
| 4,793,588 | 12/1988 | Laverty, Jr. | 4/410 X |
| 4,948,090 | 8/1990 | Chen et al. . | |
| 5,052,060 | 10/1991 | Makita et al. . | |
| 5,062,453 | 11/1991 | Saadi et al. | 4/304 X |
| 5,063,955 | 11/1991 | Sakakibara . | |
| 5,125,621 | 6/1992 | Parsons et al. . | |
| 5,265,282 | 11/1993 | Schmucki | 4/410 X |

FOREIGN PATENT DOCUMENTS

| | | |
|---|---|---|
| 3923991 | 3/1990 | Germany . |
| 2245288 | 1/1992 | United Kingdom . |

*Primary Examiner*—Kevin Lee
*Attorney, Agent, or Firm*—Connolly & Hutz

[57] ABSTRACT

A flush mechanism is provided for a urinal, wherein the working components are provided within a two-part, sealed housing. A button is provided on the cap portion of the housing to flush the urinal. Depression of the flush button signals a battery-powered solenoid to open for a preset amount of time, allowing water into the mechanism from a supply line. The flow of water in each flush is further regulated by an adjustable flow-control valve. All working components can be accessed for replacement or maintenance with only a minimum of disassembly of the flush mechanism.

16 Claims, 3 Drawing Sheets

PUSH BUTTON FLUSH ACTIVATION SYSTEM FOR URINAL

FIELD OF THE INVENTION

The invention relates to a flushing system for urinals, and more particularly, to urinals having push button activation of a battery-powered flushing system wherein all of the components of the flushing system are accessibly positioned within a single housing.

BACKGROUND AND PRIOR ART

Urinals are normally flushed with a manually activated lever, foot pedal, or the like to deliver flush water to the urinal. Attention has recently focused on means of flushing urinals, particularly in heavily-used public settings, in a manner which controls the amount of water which is used in order to avoid unnecessary waste of water.

Attention has also been given to providing hands-free operation, whereby an automatically-activated flushing means dispenses with the need for the user to touch any part of the urinal to activate flushing. To address these concerns, the art has disclosed urinals which include a sensing means to detect the presence of a user (or the departure of a user) to activate flushing. Exemplary of prior art systems employing a sensing means to activate a flush mechanism are the following: U.S. Pat. No. 4,309,781 to Lissau; U.S. Pat. No. 2,738,448 to Bokster; U.S. Pat. No. 4,742,583 to Yoshida et al.; U.S. Pat. No. 5,063,955 to Sakakibara; and UK Patent Application 2 245 288, published Jan. 2, 1992.

Conventional lever-operated flush mechanisms are still in widespread use, but the potential for germ transmission exists using a handle flush activation, and users may forego flushing the urinal rather than pulling the handle. It would therefore be desirable to limit the amount of user contact required to a minimum, while still permitting manual operation of the flush mechanism.

SUMMARY OF THE INVENTION

An object of the present invention is to provide a urinal flush mechanism which is push-button operated to reliably deliver a predetermined amount of flush water to the urinal with a minimum of user contact.

It is a further object of the invention to provide a urinal flush mechanism in which the working components are encased within a substantially sealed housing but are nonetheless easily accessible with minimum disassembly of the housing.

It is a further object of the invention to provide adjustable flow control means within the housing, and to enable ready access to the adjustable flow control means for adjustment thereof with only minimum disassembly of the housing.

The invention relates to a flush mechanism for attachment to a urinal, which is adapted to fit or associate with the standard water connection lines supplying a conventional urinal. The flush mechanism comprises a housing which includes water inlet means and water outlet means for, respectively, receiving water from a water supply and for delivering water to the urinal during a flush. A depressable push-button is disposed on the external surface of the housing, preferably such that the surface of the push button, when it is not depressed, is continuous and flush with the surface of the housing to keep the housing essentially sealed from the environment. Flush means are provided which are responsive to depression of the push button to release a predetermined amount of flush water to the urinal. The primary components of the flush means are a membrane switch responsive to depression of the push button, a battery-powered, electromagnetic switch (solenoid) responsive to activation of the membrane switch, an electronic module (printed circuit) which processes a signal to the solenoid in response to activation of the membrane switch, a diaphragm valve associated with the solenoid, and an adjustable flow-control valve. The diaphragm valve is controllably opened by the solenoid for a predetermined time interval, allowing water to pass in from the water inlet to the flow control valve when the diaphragm valve is open. Adjustment of the adjustable flow control valve permits a controlled flow of water to pass as flush water to the urinal when the diaphragm valve is open.

In this manner, a flush of the desired, predetermined quantity of water is delivered on user demand. Only minimum user hand contact with the mechanism is required, i.e. a depression of the push button using a single finger. Service and maintainence of the flush system is facilitated by the accessibility of the working parts within the housing.

DESCRIPTION OF THE DRAWINGS

The invention will be described by reference to the accompanying drawings, in which.

DESCRIPTION OF THE PREFERRED EMBODIMENTS

In its preferred form, the working components of the flush mechanism of the invention comprise an essentially self-contained unit disposed within an outer housing. The housing is positioned relative to the urinal in any desired location or configuration, constrained only by the location of the water supply pipe and the ease of operator use, as described herein. Currently, it is preferred to situate the flush mechanism immediately above the urinal, as shown in connection with a wall-mounted urinal in FIG. 1. In this arrangment, the push button which activates the flush (described more fully herein) is situated at about chest height for the average user to permit convenient operation.

Figure 1:
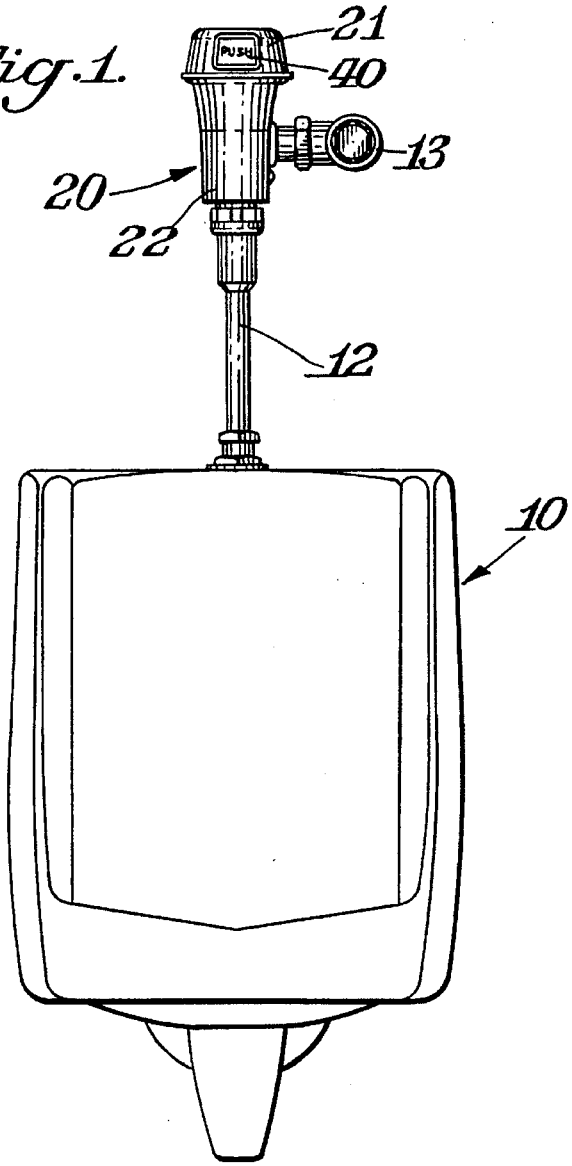
FIG. 1 is a front elevational view of a urinal having one embodiment of the flush mechanism of the invention operatively mounted above the urinal.

Referring to FIG. 1, a conventional wall-mounted urinal is shown generally at 10. Operatively mounted to the urinal above the upper edge of the urinal is a flush mechanism, contained within housing 20. As shown, the housing comprises a cap portion 21 which is detachably affixed to a bottom housing portion 22. The cap 21 and bottom 22 together define a substantially enclosed housing for the internal components. The housing is composed of a durable hard plastic or metal, to provide a moisture-free enclosure for the internal components and to be sufficiently durable to withstand heavy use or minor vandalism.

The housing cap 21 and housing bottom 22 are removeably connected to allow access, if necessary, into the cap. This may be accomplished by providing threaded bores 23 in the cap, and securing the bottom to the cap with screws 25 (See FIG. 5). Gasket 26 maintains a tight seal between the cap and the bottom of the housing.

Figure 5:
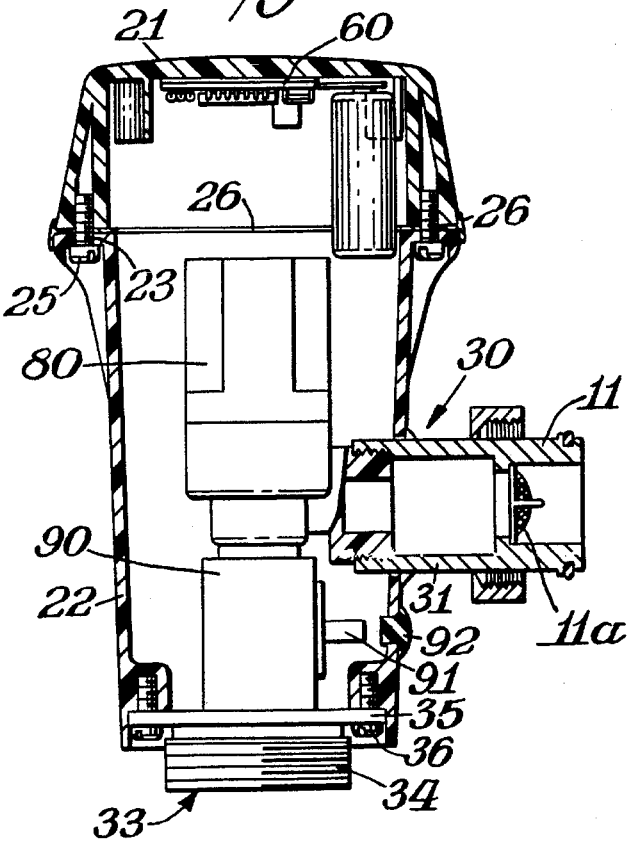
FIG. 5 is a cross-sectional view of the housing interior, taken along line 5—5 of FIG. 3, and also including a cross-sectional view of the housing bottom as seen from the same direction.

As shown in FIG. 5, the housing is provided with an inlet means in the side of the housing to connect to and receive water from a water inlet pipe 11 which supplies water to the urinal. The water inlet pipe may further include a conventional water supply stop feature, as shown at 13 in FIG. 1. The housing is also provided with a water outlet means in the bottom which connects to outlet pipe 12 to provide flush water from the flush mechanism within the housing to the urinal. As will be appreciated, the flow of water during operation proceeds from inlet pipe 11, through the flush mechanism within housing 20, from the flush mechanism into the outlet pipe 12, and into the urinal.

Figure 2:
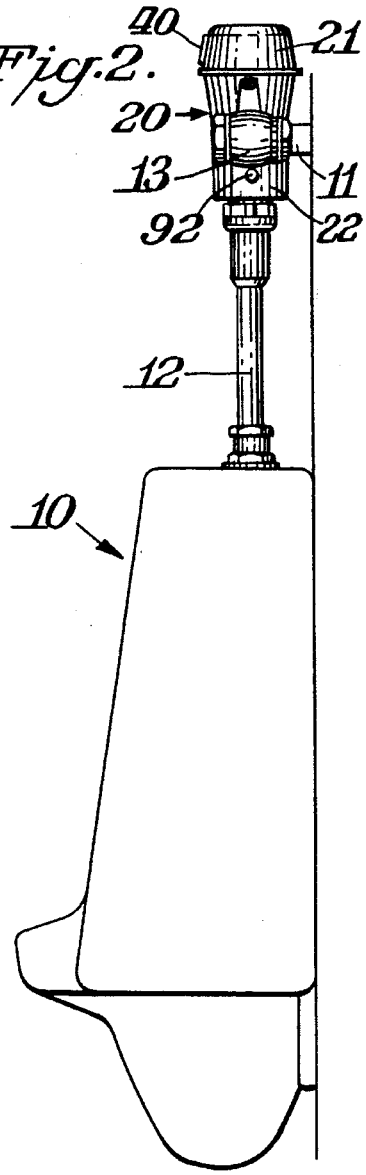
FIG. 2 is a right side elevational view of the embodiment of FIG. 1.
Figure 4:
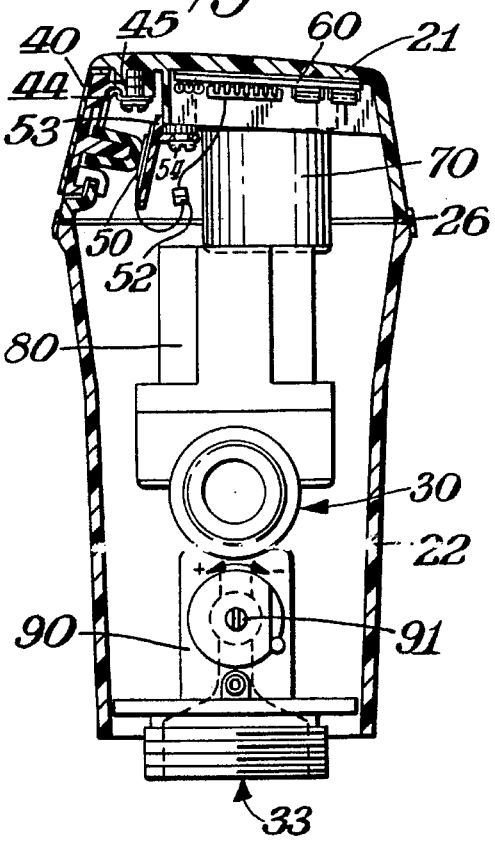
FIG. 4 is a side cross-sectional view of the housing interior, taken along line 4—4 of FIG. 3, and also including a cross-sectional view of the housing bottom as seen from the same direction.

On the surface of the housing facing the user, preferably in the housing cap 21, is push button 40, which activates the flushing mechanism to flush the urinal. As seen in FIGS. 2 and 4, push button 40, when not depressed, is substantially flush with the surface of the housing cap 21. Together the cap and push button provide a substantially continuous, water tight surface which protects the components within the housing cap.

Referring to FIG. 5, the water inlet means is shown generally at 30. The inlet means comprises an opening in the housing to which is connected the water inlet pipe 11, for example using a brass coupling tube 31. The inlet water may be filtered by screen 11*a* before it enters the flush mechanism. The outlet means is shown generally at 33, and provides means to operatively connect the oulet pipe 12 to the flush mechanism housing. For example, nipple connector 34 is coupled to outlet pipe 12, and forms a fluid pathway from the adjustable flow control valve (described infra) to the outlet. The housing is affixed to the outlet pipe, for example, by providing a bottom plate 35 which is screwed to the housing bottom 22 by screws 36.

The internal components of the flush mechanism will be described generally prior to describing each in detail. The components include the push button 40, a membrane switch 50, an electronic module preferably in the form of an epoxy-embedded printed circuit 60, a battery 70, a solenoid 80 and associated diaphragm valve (not shown), and an adjustable flow control valve 90.

Figure 7:
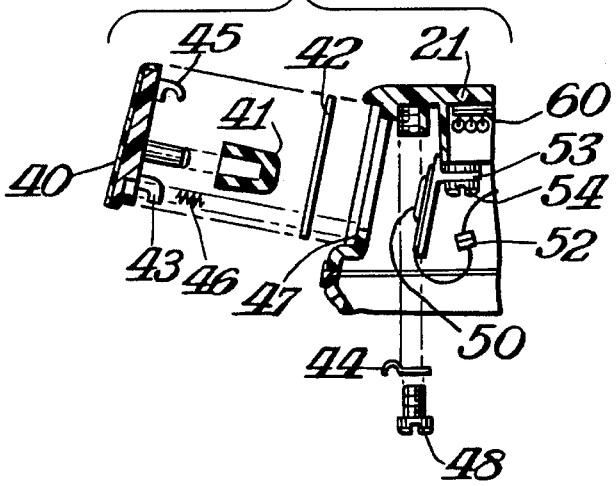
FIG. 7 is an exploded, fragmental view of a cross-section of the push button and membrane switch within the housing cap.

As shown in FIG. 7 in exploded detail, the push button 40 is mounted in an opening in the front of the housing cap 21 by a clipping-type arrangement. Bottom hooks 43 on the button engage the lower edge of the opening. Clip 44 is held by a screw 48 in the upper surface of the cap to position clip 44 where it can engage upper hooks 45 to hold the button in place. See also FIG. 4. A seal between the button and the cap is maintained by O-ring 42. When the button is in place, it is biased outwardly by springs 46, which are situated between the button and a small ledge portion 47 on the lower edge of the cap opening. The button includes an activator pad 41, which contacts the switch, as described hereinafter. The surface of the switch 40 which is touched by the user's finger may contain a germicide incorporated within the material to minimize transfer of contaminants among users.

Figure 3:
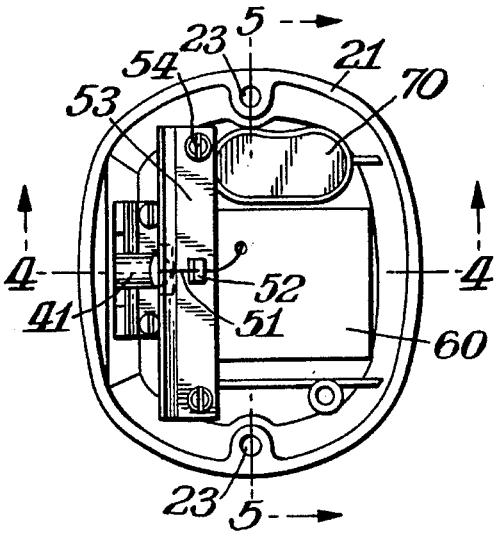
FIG. 3 is a bottom plan view of the components within the cap portion of the housing.
Figure 6:
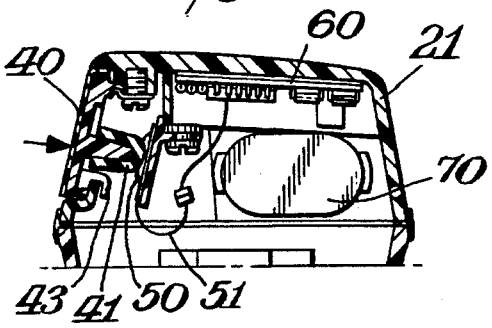
FIG. 6 is cross-sectional view of the components within the cap portion of the housing, showing the battery in an alternate position within the housing.
Figure 8:
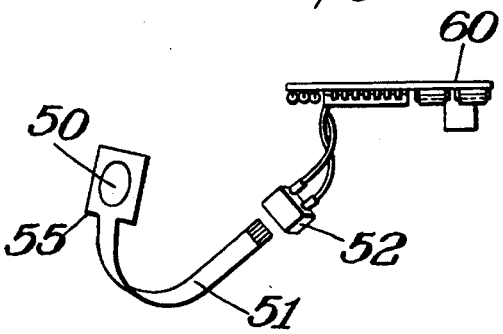
FIG. 8 is a pictorial view illustrating the connect/disconnect between the membrane switch and the printed circuit board.

Switch 50 is a conventional membrane-type switch and is not described in detail. The switch includes lead portion 51 (FIG. 8) and rapid-disconnect portion 52, which is operatively attached to the printed circuit board 60 to carry a signal from the switch to the printed circuit. As seen in FIGS. 3 and 4, the switch is mounted in the cap of the housing by a switch plate 53 which is mounted on the inner surface of the top of the cap by screws 54. The square portion 55 of the switch fits into a receiving area on the switch plate 50 (receiving area not shown) to hold the switch in its normal, mounted position. As seen in FIG. 4, when the switch is mounted, the activator pad 41 of the push button is disposed against the switch, but does not contact it with sufficient force to activate the switch in the absence of a deliberate push on the push button. The quick-disconnect feature 52 allows replacement of the lead portion 51 in the event of failure without disconnecting the contact to the printed circuit board. It should also be noted that, to replace a failed switch, it is necessary only to unscrew the housing cap, slide the square portion 55 from the switch plate, disconnect the quick-disconnect 52, and reverse the same procedure to install a new switch with a minimum of labor and disassembly.

The electronic module is preferably a printed circuit board 60 which is mounted on the upper, inner surface of the housing cap 21 for example with an adhesive. The printed circuit is also conventional and is not described in detail. Using appropriate circuitry, a signal from the membrane switch allows current from the battery to activate the solenoid to open the diaphragm valve associated with the solenoid for a predetermined time interval. The circuitry can also accommodate and integrate additional signals into the operation. For example, an override signal (generated, for example, by a second press of the push button) could disengage the current from the battery and thus stop a flush already in progress. Timing means could be provided in the circuitry to provide for additional flushing functions complementary to the manual push button flush, such as automatic flushing at predetermined time intervals or at a predetermined time after the last manually-activated flush. The electronic module car receive and process more than one input signal, for example if sensing means are used in conjunction with the manual push button flush means.

Battery 70 is preferably a lithium type battery and is positioned by clip means in the housing cap for easy removal and changing.

The solenoid 80 is an electromagnetic switch means of the type known in the art. The operation of such a solenoid is described generally in U.S. Pat. No. 4,948,090 and U.S. Pat. No. 4,611,356. In preferred form, the solenoid acts together with an associated diaphragm valve (not shown). In operation, a signal from the printed circuit board 60 allows power from the battery to reach the solenoid to activate the solenoid for a predetermined time, during which time the solenoid opens the diaphragm-type valve and allows water to pass from the inlet means 30, through the diaphragm valve, and into the adjustable flow control valve 90.

The adjustable flow control valve 90 is positioned to receive water from the diaphragm when the solenoid is open and to allow it to pass into outlet means 33 to the urinal. The flow control valve 90 is adjustable in the sense that the size of the internal aperture allowing water to pass through the valve can be controlled by adjustment, for example by adjustment screw 91, as shown in FIGS. 4 and 5. A removeable plug 92 is provided in the housing bottom directly in front of the adjustment screw, such that, to adjust the flow, one need simply remove the plug 92 and fit a screwdriver into the opening in the housing bottom to reach the adjustment screw and make the necessary adjustment.

Thus, it will be understood that the amount of water delivered to the urinal in a flush will depend, first, upon the predetermined time for which the solenoid remains open upon flushing, which is governed by selection of the appropriate printed circuit control of the solenoid. While the solenoid is open, water is allowed from the inlet through the diaphragm valve associated with the solenoid. The water arriving through the diaphragm valve passes into the adjustable flow control valve, where the amount of water delivered to the urinal for the flush may be further regulated. In this manner, very precise control over the amount of flush water delivered per flush is achieved. Lastly, it will be appreciated that, by placing the operating components in the removeable cap and providing easy access to the flow control, normal repair and maintenance is greatly facilitated.

While the invention has been described in terms of certain currently preferred embodiments, variations of such embodiments will occur to those skilled in the art. For example, additional flush activation means such as sensing means could be used in addition to, or in combination with, the push button activation described herein. Sensing means (e.g. sonic, infrared or pyroelectric sensing means) and associate, signal-generating means could be provided either within the housing or remote to the housing, and the signal from the signal-producing means could be integrated into the electronic module control described previously to activate a flush independently of the push button, if desired. For example, if it were to be determined that a significant number of users were failing to flush using the push button, the alternate sensing means could be set to activate automatically upon each use of the urinal. Also, as noted above, it may be desireable to incorporate timing means into the electronic module to provide an automatic flush function which activates at predetermined time intervals.

What is claimed is:

1. A flush mechanism for attachment to a urinal, comprising:

a housing With an external surface which provides water inlet means and water outlet means for, respectively, receiving water from a water supply and for delivering water to the urinal during a flush;

a depressible push-button disposed on the external surface of the housing, the push-button and the housing together forming a substantially sealed and continuous external surface around the flush mechanism;

flush means responsive to the depression of the push button to release a predetermined amount of flush water to the urinal, the flush means comprising a switch responsive to depression of the push button, a battery, a battery-powered solenoid responsive to activation of the switch, an electronic module in the form of a printed circuit which transmits a signal from the switch to the solenoid, and a valve associated with the solenoid which, in response to a signal from the printed circuit, opens for a predetermined time to allow water to pass through the flush mechanism from the inlet means providing said predetermined amount of water to the urinal.

2. The flush mechanism of claim 1, wherein the housing and the push button are composed of a durable resin or plastic material, and the push button, in a non-depressed condition, has a surface which is substantially flush with the surface of the housing to provide the substantially sealed, continuous external surface.

3. The flush mechanism of claim 1, wherein the switch is a membrane switch underlying and in operative contact with the push button such that depression of the push button activates the membrane switch.

4. The flush mechanism of claim 1, wherein the housing comprises a base portion and a removeable cap portion, and wherein the push button, the switch, and the battery are disposed within the removeable cap portion.

5. The flush mechanism of claim 4, wherein the water inlet means, solenoid, adjustable flow-control valve, and water outlet means are provided in the base portion of the housing.

6. The flush mechanism of claim 5, wherein the housing is provided with a removeable access plug on the base portion of the housing and the adjustable flow control valve is positioned within the base portion of the housing to be accessible from outside the housing when the removeable access plug is removed, whereby the adjustable flow-control valve may be adjusted from the exterior of the housing by removing the removeable access plug.

7. The flush mechanism of claim 1, wherein the push button contains a germicidal agent.

8. The flush mechanism of claim 1, wherein the battery powering the solenoid is a lithium battery.

9. In combination with a urinal, a flush mechanism provided in a user-accessible position above the urinal to provide flushing water to the urinal, the flush mechanism comprising:

a housing with an external surface which provides water inlet means for receiving water from a water inlet pipe associated with the urinal and water outlet means for delivering water to an outlet pipe which supplies water to the urinal during a flush;

a depressible push-button disposed on the external surface of the housing, the push-button and the housing together forming a substantially sealed, and continuous external surface;

flush means responsive to depression of the push button to release a predetermined amount of flush water to the urinal, the flush means comprising a switch responsive to depression of the push button, a battery, a battery powered solenoid responsive to activation of the switch, a printed circuit which transmits a signal from the switch to the solenoid, and a valve associated with the solenoid which, in response to a signal from the printed circuit, opens for a predetermined time to allow water to pass through the flush mechanism from the inlet means, and an adjustable flow control valve which delivers water to the outlet means, providing said predetermined amount of water to the urinal.

10. The combination of claim 9, wherein the housing and the push button comprise a durable resin or plastic material, and the push button, in a non-depressed condition, has a surface substantially flush-with the surface of the housing to provide the substantially sealed, continuous external surface.

11. The combination of claim 9, wherein the switch is a membrane switch wherein the membrane of said switch is in contact with the push button such that depression of the push button activates the membrane switch.

12. The combination of claim 9, wherein the housing comprises a base portion and a removeable cap portion, and wherein the push button, the switch, and the battery are disposed within the removeable cap portion.

13. The combination of claim 12, wherein the water inlet means, adjustable flow-control valve, and water outlet means are provided in the base portion of the housing.

14. The combination of claim 13, wherein the housing is provided with a removeable access panel on the base portion of the housing and the adjustable flow control valve is positioned within the base portion of the housing to be accessible from outside the housing when the removeable access panel is removed, whereby the adjustable flow-control valve may be adjusted from the exterior of the housing by removing the removeable access panel.

15. The combination of claim 9, wherein the push button contains a germicidal agent.

16. The combination of claim 9, wherein the battery is a lithium battery.

* * * * *